US009605387B2

(12) United States Patent
Dehmel

(10) Patent No.: US 9,605,387 B2
(45) Date of Patent: Mar. 28, 2017

(54) RAILWAY WORK VEHICLE

(75) Inventor: Wolfram Peter Dehmel, Passau (DE)

(73) Assignee: K & K MASCHINENENTWICKLUNGS GMBH & CO. KG, München (DE)

( * ) Notice: Subject to any disclaimer, the term of this patent is extended or adjusted under 35 U.S.C. 154(b) by 217 days.

(21) Appl. No.: 14/118,134

(22) PCT Filed: May 15, 2012

(86) PCT No.: PCT/EP2012/059052

§ 371 (c)(1),
(2), (4) Date: Jan. 17, 2014

(87) PCT Pub. No.: WO2012/156417

PCT Pub. Date: Nov. 22, 2012

(65) Prior Publication Data

US 2014/0202352 A1 Jul. 24, 2014

(30) Foreign Application Priority Data

May 16, 2011 (DE) ..... 10 2011 101 636
Aug. 19, 2011 (DE) ..... 10 2011 111 026
Mar. 15, 2012 (DE) ..... 10 2012 005 287

(51) Int. Cl.
*E01B 29/02* (2006.01)
*B61D 15/00* (2006.01)
(Continued)

(52) U.S. Cl.
CPC ..... *E01B 29/02* (2013.01); *B61D 15/00* (2013.01); *B61D 49/00* (2013.01); *E01B 27/00* (2013.01); *E01B 29/00* (2013.01)

(58) Field of Classification Search
CPC ..... E01B 27/00; E01B 27/02; E01B 27/04; E01B 27/12; E01B 27/13; E01B 29/00; E01B 29/02; E01B 29/16
(Continued)

(56) References Cited

U.S. PATENT DOCUMENTS 4,160,418 A * 7/1979 Theurer ..... E01B 29/00 104/2
4,275,659 A 6/1981 Theurer et al.
(Continued)

FOREIGN PATENT DOCUMENTS

CN 2552999 Y 5/2003
DE 960 288 B 3/1957
(Continued)

OTHER PUBLICATIONS

Article "Schotterbettreinigung" by Dr.-Ing. Rosemarie Schilling, ZEVrail Glasers Annalen 129 (2005), Oct. 10. Abstract of article.

*Primary Examiner* — R. J. McCarry, Jr.

(57) ABSTRACT

The invention relates to a railway work vehicle comprising a chassis supported by a drive mechanism and work devices supported by the chassis. According to the invention, the transportation of material within the work vehicle below and/or above and/or next to the working devices can be improved by using at least one conveyor track on which conveyor bodies for objects or objects forming conveyor bodies, in the form of a parceled goods, can be driven along the working vehicle.

37 Claims, 1 Drawing Sheet

(51) Int. Cl.
*E01B 27/00* (2006.01)
*E01B 29/00* (2006.01)
*B61D 49/00* (2006.01)

(58) Field of Classification Search
USPC ..... 104/2–9
See application file for complete search history.

(56) References Cited

U.S. PATENT DOCUMENTS

| | | | | |
|---|---|---|---|---|
| 4,465,414 | A | 8/1984 | Theurer et al. | |
| 5,727,474 | A * | 3/1998 | Theurer ..... | B60F 1/046 104/2 |
| 5,778,795 | A | 7/1998 | Kusel et al. | |
| 7,516,702 | B2 | 4/2009 | Theurer et al. | |

FOREIGN PATENT DOCUMENTS

| | | | |
|---|---|---|---|
| DE | 2 065 989 | A1 | 9/1977 |
| DE | 27 13 634 | A1 | 12/1977 |
| DE | 29 09 721 | A1 | 12/1979 |
| DE | 29 13 639 | A1 | 3/1980 |
| DE | 32 28 015 | A1 | 7/1983 |
| DE | 3641917 | A1 | 6/1988 |
| DE | 42 13 925 | A1 | 8/1993 |
| DE | 196 50 443 | A1 | 7/1997 |
| DE | 196 37 218 | A1 | 3/1998 |
| DE | 298 20 833 | U1 | 1/1999 |
| DE | 202 16 202 | U1 | 12/2002 |
| DE | 101 64 821 | B4 | 11/2009 |
| DE | 102009 041 237 | A1 | 4/2011 |
| DE | 102010 014 596 | A1 | 10/2011 |
| EP | 1 568 562 | A1 | 8/2005 |
| EP | 1 775 190 | A2 | 4/2007 |
| GB | 1559258 | A | 1/1980 |
| GB | 2029874 | A | 3/1980 |
| GB | 2113168 | A | 8/1983 |
| WO | 2007017309 | A1 | 2/2007 |

* cited by examiner

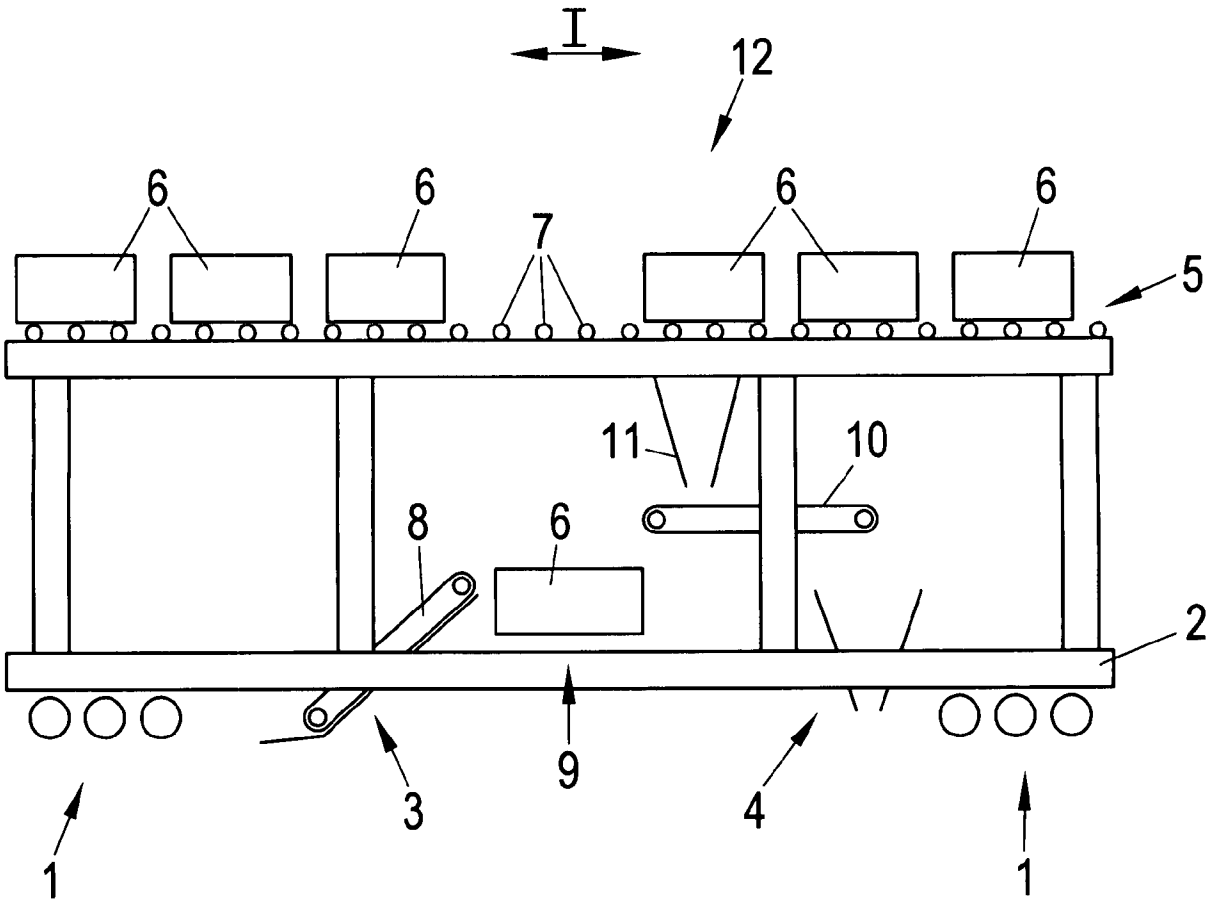
5
6
6
12
I
7
6
6
2
1
10
4
11
6
9
8
3
1

RAILWAY WORK VEHICLE

The present invention relates to a railroad work vehicle having a chassis supported by a truck and having work devices supported by the chassis.

Work on railroad tracks is carried out in a rail-mounted manner as much as possible since the disruption of the rail traffic and the burden on the environment can thereby be kept small. Railgoing work vehicles such as tamping machines, ballast plows, fast track renewal trains, ballast cleaning machines, foundation rehabilitation machines, formation improvement machines, recycling formation improvement machines, and the like, but also machines for the removal, replacement or new production of rail carriageways, are used for this purpose. Combination machines such as ballast cleaning renewal machines are furthermore used.

Material transportation within the vehicle is required in the course of the work carried out by work vehicles. For example with a ballast cleaning machine, ballast thus has to be transported from the take-up site of the machine to the cleaning device of the machine and from there to the reinstallation site. With a machine for the new production of a rail carriageway, the total material such as gravel, sand, cement, sleepers, ironware, etc. has to be transported to the corresponding work site of the machine. With a machine for the removal of rail carriageways, material accordingly has to be transported away from the corresponding work sites of the machine. The transport of a complete track section away from the work site or toward the work site can also be desired in track construction work.

It is the underlying object of the invention to provide an advantageous transportation possibility for such materials within the work vehicle.

This object is satisfied in that at least one conveyor track is provided beneath and/or above and/or next to the work devices, with transport bodies for articles or articles forming transport bodies in the form of general cargo being able to be transported along the work vehicle on said conveyor track.

In accordance with the invention, transport bodies, in particular transport containers, which can be moved along the work vehicle on the conveyor track or on the conveyor tracks are therefore used for the transportation of materials within the work vehicle. This has the advantage inter alia that any desired materials can be transported with the same means within the work vehicle, that is in particular bulk material such as sand, cement, gravel, ballast and the like, but also ironware, sleepers, liquids such as fuels and water and whatever else is required or has to be disposed of, that is has to be transported. A transportation of general cargo such as rails, sleepers or of a complete track section is possible with a suitably designed conveyor track. In this case, the track section e.g. itself forms a transport body in the sense of the invention. The invention additionally has the advantage that the transport bodies cannot only be used for transportation within the work vehicle, but also for the transportation of material beyond the work vehicle. Fuels can thus, for example, be transported in on one side of the work vehicle by corresponding track vehicles and can be conveyed beyond the work vehicle to a track vehicle located on the other side of the work vehicle, for example to the drive unit of a supply train.

An advantage of the use of transport bodies instead of transport belts comprises the fact that no segregation of the bulk goods takes place and the contamination is smaller. Furthermore, different materials can be simultaneously transported on one and the same conveyor track in that they are each transported in a separate transport body. It is also possible to work flexibly since the transport containers are movable individually in any direction as long as the transport path is free in the corresponding direction. However, two or more conveyor tracks for transport bodies can also be provided. The transport is thereby even more flexible. In addition, there is thereby the possibility of resorting the transport bodies in that transport bodies are swapped between the conveyor tracks. In addition to these advantages, the transport process security is also increased by the use of transport bodies.

The provision of two or more conveyor tracks in parallel with one another allows a continuous transport in and/or transport away of material in that the transport bodies are moved on a conveyor track to a loading or unloading station and are filled or unloaded there and are loaded or unloaded on another conveyor track and moved away from the loading station or unloading station again. It is moreover preferred if the transport bodies are movable in both directions, in particular also individually, on the conveyor tracks. The system is thereby particularly flexible. The conveyor tracks can in another respect be configured, for example, as carriageways, roller conveyors, slideways, elevated tracks, suspended tracks, conveyor belts, conveyor chains or the like.

The use of transport bodies also has the advantage that the work vehicle can easily be configured such that the train traffic remains possible on an adjacent track during use. It is also relatively easily possible to maintain a predefined loading gauge with the work vehicle during the use and/or the transportation of the work vehicle.

The transport bodies are preferably movable on the conveyor track without any additional loading means such as cranes. Furthermore, the transport bodies are preferably movable directly on the conveyor track. Furthermore, the conveyor track preferably extends substantially horizontally. The complex and expensive provision of gantry cranes or the like can thus be avoided.

In accordance with another embodiment of the invention, an apparatus for the machine transfer of transport bodies between the work vehicle and another work vehicle or a transport vehicle is provided at at least one end of the work vehicle and material for the work vehicle is transported in and/or away by it. A fast and simple supply and disposal of the work vehicle can thus be ensured.

It is generally also possible to provide a lateral loading and unloading possibility for the transport bodies. Transport bodies can thereby also be removed from the side and can be swapped for other transport bodies in order e.g. to replace a transport body filled with waste material with an empty transport body, to replace an empty transport body for another transport body with supply material or to receive an old track section and afterward to place a new track section down. This loading and unloading possibility can also comprise only the fact that the work vehicle provides an access possibility for the loader and unloader such as an excavator or a lifting vehicle.

The transport bodies can be configured as open or closed containers or as board-like supports. Open containers are simple to load, whereas closed container provide good protection for the transported goods. Board-like supports are particularly suitable for bulky goods.

The transport bodies can be removable from the conveyor track, e.g. by lowering, for the loading process. A conveyor track operation is still also possible during the loading process in this manner.

To move the transport bodies along the conveyor tracks, a drive, for example driven rollers, can be provided at them.

A drive can, however, also be provided at the transport bodies themselves or at another point of the work vehicle, for example to the side of the conveyor tracks. A drive at the work vehicle has the advantage that the transport bodies can be configured very simply, for example as simple transport boxes.

The drives are preferably configured such that a cornering of the transport bodies can be produced with them corresponding to the track arc of the travel track and/or such that a movement of the transport bodies is also possible at upward gradients, downward inclines and cambers of the track. It is thereby possible to move the transport bodies over any desired travel path.

The transport bodies can further preferably be movable singly and/or in groups and/or together. The flexibility of the work vehicle is thus further increased. It is inter alia possible with upward gradients to move fewer than all the transport bodies simultaneously to keep the required performance and the required energy effort small. The common movability allows a fast loading and/or unloading. The individual movement possibility facilitates a resorting of the transport bodies.

The transport bodies can be couplable to one another in accordance with a further embodiment of the invention mechanically and/or by a corresponding control. Two or more transport bodies can thereby be moved together in a simple manner.

In accordance with a further embodiment of the invention, the transport bodies can be latched with respect to a conveyor track or with respect to the railroad work vehicle. It can hereby be prevented that the transport bodies move on their own on the moving of the railroad work vehicle.

In accordance with a further embodiment of the invention, the transport bodies are provided with a machine-readable code. The loading and/or unloading procedure can thereby be automated. A remote control of the loading and/or unloading of the transport bodies and of the movement of the transport bodies is also possible in accordance with a further embodiment of the invention The railroad work vehicle can also be configured with an additional loading and/or conveying possibility for goods such as liquids or gases, in particular with mutually couplable pipes. A supply with required water and/or fuel and/or a disposal of waste water can thus be made possible.

The railroad work vehicle in accordance with the invention can be configured as open or have a top and/or side walls. If a top is provided, in particular open transport bodies are protected from weather effects. In addition, the required electrical insulation with respect to a traction current line is ensured. Weather influences can furthermore be kept off by side walls and the aerodynamics of the work train for ferrying trips can be improved. In addition, the noise pollution drops.

The railroad work vehicle can additionally be equipped with a travel drive for moving on a track. A locomotive can thereby become superfluous.

The railroad work vehicle in accordance with the invention can have a rail-mounting and/or a travelling base, in particular a crawler base. A movement of the work vehicle is thus possible under different conditions. Rollers, wheeled trucks, traveling assemblies or other suitable trucks can be used as traveling bases. Depending on the amount of the support load to be carried off, such trucks can also include crawler track chains, rubber tracks or rubber wheels. The advantage of a traveling assembly in particular comprises the fact that it only requires a relatively small construction height. A traveling assembly can furthermore be easily configured with a relatively large standing surface in order thus to keep the specific surface pressure small. Traveling assemblies moreover allow a comparatively stiff support. In addition to the above-named trucks, an auxiliary truck can also be provided for carrying off additional loads.

In accordance with a particularly preferred embodiment of the invention, the work vehicle in accordance with the invention comprises two or more modules each having at least one work device, preferably a group of work devices, for a complete workstep such as ballast cleaning, track removal, track installation, track renewal, point renewal, soil excavation or soil installation, construction of drainage systems as well as lifting work, erection work and tamping work. The individual modules can be assembled as required. The effort and costs of an assignment can thus be kept small. One problem with conventional work vehicles namely comprises the fact that a largely rigid structure is present which only allows changes in functionality with restrictions. The flexibility is considerably increased by a modular design.

In accordance with a further embodiment of the invention, the conveyor tracks are configured to form a respective continuous conveyor track with conveyor tracks of a further work vehicle or module or other track vehicle having corresponding conveyor tracks. A simple swapping of transport bodies can thus take place between the named vehicles or modules.

A method for carrying out work at rail carriageways is characterized by the use of a railroad work vehicle of the above-described kind. Modules of the railroad work vehicles are preferably assembled as required for carrying out the work. The modules can also be provided temporarily to keep the length of the work vehicle as small as possible. The order of the modules can also be varied during the carrying out of the work, for example to keep a point free for as long as possible for the other traffic or to occupy it as late as possible. A module arranged at the front at the work vehicle can thus be relocated to the end or to another point of the work vehicle when approaching points. After the other modules of the work vehicle have passed the points, the module can be relocated at the front end of the work vehicle again as required. This naturally only works with modules which do not technologically require a specific order in their operation.

A plurality of modules which are the same can also be provided of which a corresponding number is assembled as required. For example, one or more recycling modules can thus be assembled depending on a desired intensity and a desired extent of the recycling work.

The use of modules has the advantage, in addition to the flexibility in the arrangement of the modules, that the components of the railroad work vehicles are each relatively small per se. There is thereby the possibility of configuring the work vehicle as transportable, in particular transportable by ship.

Common conveying components such as wheelsets, their suspension or devices for braking or coupling the corresponding train can be provided for ferrying a plurality of modules.

A ferrying of a module by means of a traveling base as described above can also take place when the module does not have its own track mounting. For example, the module could drive against a car train of low-loader vehicles or against one or more trucks by means of the traveling base.

The modules can be provided with a suspension for the ferrying operation, with the suspension preferably being able to be bridged mechanically to ensure a higher stability in work operation.

In addition, the modules can be equipped with an apparatus with which the module base or apparatus attached to the module can also be held horizontally during traveling over elevated tracks and/or of tracks at upward gradients or downward inclines.

In specific applications, the ferrying of the modules can take place using a train of container wagons on which suitable support boards are located as transport bodies. These support boards are equipped with fixed work devices or with work devices which are easy to assemble and to dismantle. Such support boards are preferably compatible with common standard containers such as are known in the technical area. Such support boards can be loaded and transported together with the associated work devices using the container conveying infrastructure present at many locations.

Furthermore, means for supporting the modules on the ground can be provided. This support preferably takes place only on layers which are either still to be removed or which have already been installed and compacted. The support on the contacting ground can thus be avoided. It is favorable to design the support means such that the specific surface pressure is as small as possible. If the specific surface pressure is smaller than, for instance, the pressure under the shoe of an operator of the work device, no significant impairment of the foundation by the support is to be expected.

The modules can each have an apparatus for the optical and/or acoustic warning of the operator a train trips or about movements on the conveyor track.

Furthermore, the modules can have peripheral metal sheets which allow the operator to move quickly from module to module without having to dismount for this purpose.

The modules can also have means for securing against falls which e.g. facilitate the use of the respective work device on bridges.

The modules can generally be designed in container construction and can be removable from the truck of the associated railroad work vehicle. Such work containers—without associated railroad cars—can be set down at a fixed location temporarily, for example as part of a stationary ballast recycling plant or of a plant for ground washing. If such a plant is completely designed in container construction, it can be particularly easily transported by sea and/or by land. The transportation in this respect advantageously takes place independently of the gauge of the track carriageway.

The transport bodies can be conveyed by means of the conveyor track along the modules, from module to module and from work modules to other modules such as purely transport modules or logistics modules which are provided at one side or at both sides of a work module.

A common infrastructure for exchanging data can be provided for an arrangement of a plurality of modules. In this manner, in particular data with respect to the supply or removal and/or with respect to the forwarding of correspondingly filled or empty transport containers, of energy, of consumables such as washing water or fuel, or of auxiliary materials such as lubricant can be replaced and/or forwarded. For example, a master computer can receive information with respect to the respective container content by means of such a data transfer.

The modules can be tailored in a variety of ways to specific applications. For example, a track section removal module can be provided.

Experience has shown that the strain on the rail due to the tensile stress from the bending is the largest in the region of the last wheelset traveling on the rail. The deflection curve of the rail, and thus the maximum tensile stress in the rail foot, can be favorably influenced by correspondingly controlled press rollers.

The ironware can be released by unscrewing or by violent destruction. A corresponding apparatus for releasing ironware can optionally be designed as easily replaceable. The track section removal module can thus easily be adapted to different ironware types. The transport in and off of the release apparatus can favorably take place by a transport body equipped for this purpose and suitable for transport on the roller track. For instance, an ironware release apparatus for rare ironware types only has to be stored once for a plurality of modules and can be easily swapped between them.

Optionally, the track section removal module can have an apparatus for preparing the taken-up rails for a subsequent transportation. Such a preparation can e.g. be the removal of burrs, weld seams or flash rust.

Optionally, an easily contactable surface can be provided by a corresponding material removal, for instance on the later travel surface of the rail, to establish a grounding carried out by the machine.

Optionally, an apparatus for cutting the removed rails to length can be provided. A cutting of the rails into small pieces can be necessary to make possible the taking up of the rails into a container.

Furthermore, the track section removal module can comprise a device for separating the rib plates from the associated wooden or concrete sleepers and optionally a device for removing the head bindings of the wooden sleepers. Wooden sleepers can thus e.g. be prepared for thermal disposal directly on the track section removal module. The transporting off of the sleepers can also take place in a particularly space-saving manner.

A great advantage of the track section removal module comprises the fact that, apart from a relatively short section, wear-prone rollers can be completely dispensed with during the merging such as are used, for instance, in the rail carrying claws of known ballast cleaning machines.

The track section removal module can also have an apparatus for detecting the geometrical data of the track before the removal. This apparatus can be configured to set the detected geometrical data into relationship with other geometrical data such e.g. as fixed measurement points. A control device or an operation can make use of these data during the installation of the new track section.

An apparatus can also be provided which documents the state of the track photographically before the removal. The data thus acquired can serve as a basis for any supplementary demands.

Furthermore, the track section removal module can have an apparatus which is configured to photographically document the state of the removed sleepers and/or of the removed rails In accordance with a further embodiment of the invention, a ballast removal module is provided. Such a module takes a layer of ballast and/or a layer of formation level from the track bed. The removal of the bulk material in this respect takes place in an advantageous manner using a bucket as with a wheel loader. Such an excavation bucket is a simple component in comparison with a typically used excavation chain and its wear is much smaller than the wear of a chain. In addition, a worn bucket can be repaired easily and inexpensively, e.g. by welding on. A complete replacement of the bucket is likewise possible fast and inexpensively. The replacement of an excavation chain is in contrast considerably more complex and more expensive.

The fastening of the bucket to the machine can take place using a fast-change connection which makes it possible that a bucket change can take place partly automatically or fully automatically and in particular on site at the construction site. The transportation in and out of the bucket can take place using a specific transport container on the conveyor track of the bulk material removal module. In this manner, a wide bucket can e.g. easily be replaced with a narrow bucket, or vice versa, in construction site operation. A bucket having digging teeth can equally be replaced with a bucket having a cutting edge, or vice versa The bucket could also be replaced with another work device such as a hammer, a drill or a hammer drill.

A precise guidance of the bucket can be effected using a guide apparatus in a hexapod construction. Furthermore, a traveling assembly can provide the required tensile force for guiding the bucket.

The emptying of the bucket can take place by gravity or can be enforced at least temporarily. It is avoided by an enforced emptying that material with a high clay content sticks in the bucket.

The control of the bucket can take place manually, by remote control or automatically depending on the application. A manual control can be carried out by means of an operating unit which can selectively be installed in mobile or fixed form. A fixedly installed operating unit can be attached in a driver's cab, and indeed either process-oriented before the bucket or result-oriented behind the bucket.

A manual control can be assisted by auxiliary functions such as an electronic depth stop. An apparatus can equally be provided which prevents the unwanted penetration of the bucket into the loading gauge of a counter-track or of a plurality of counter-tracks.

An apparatus for tracing metals hidden in the soil such as unexploded shells can furthermore preferably be provided behind the excavation bucket.

The above-described bulk material removal module can easily be adapted to further work such as the extraction of lateral trenches or center trenches.

The bulk material removal module preferably allows the buffering of a specific quantity of removed material. The conveying of the transport bodies on the conveyor track can hereby be further optimized.

Where required, the bulk material removal module can also comprise an excavation chain or a bucket elevator.

An arrangement of a plurality of bulk material removal modules arranged in rows can in particular be provided on a multilayer removal. Generally, however—with correspondingly slow work progress—removal can also take place in two layers or in multilayers using a single bulk material removal module.

An apparatus for weighing the loaded transported bodies can also be provided. This apparatus could also be configured for determining the center of gravity of the loaded transport bodies.

Furthermore, a bulk material removal module could also have an apparatus for the geometrical measurement of the foundation before and after the excavation.

A bulk material removal module can furthermore have an apparatus for determining the load rating of the foundation before and/or after the excavation.

Furthermore, an apparatus can be provided for the photographic documenting of the foundation before and/or after the excavation.

In accordance with a further embodiment, a bulk material installation module is provided which is configured to remove at least one loaded transport body from the conveyor track, to empty it into a storage bunker and subsequently to install the contents of the transport body and optionally to compact it.

The bulk material installation module can be configured to install one or more layers of geotextile, geogrid and/or polystyrene boards. The material required for this purpose can advantageously be conveyed in by means of transport bodies on the conveyor track. The transport body can be removed from the conveyor track during the emptying.

The bulk material installation module can furthermore have an apparatus for the chemical solidification of the upper layer and/or of a side layer or of two side layers. A chalk layer or a cement layer can in particular be applied for the chemical solidification.

The bulk material installation module can also have an apparatus which is configured to compact the edge or the two edges of the installed layer at the shoulder, i.e. to the side at the left and/or at the right.

Furthermore, the bulk material installation module can have an apparatus for determining the moisture of the bulk material to be installed, an apparatus for the defined moistening of the bulk material to be installed, an apparatus for washing the ballast, an apparatus for compacting the base ballast bed, an apparatus for detecting the compacting parameters and/or an apparatus for detecting the installed bulk material amount. In another respect, the bulk material installation module can be equipped with the same auxiliary and additional apparatus as described above with respect to the bulk material removal module.

In accordance with a further embodiment, a combined bulk material installation module and bulk material removal module is provided which combines the functions of the bulk material removal module with those of the bulk material installation module. Such a module is preferably arranged into the work configuration at the center of the site of work modules, at their lowest point. On the one hand, the length of the lowest section of the construction site can be kept relatively short with such a combined module and, on the other hand, the load removal on the contacting foundation can be avoided.

A combined bulk material installation module and bulk material removal module can be equipped with a migrating trench lining on the left side and/or on the right side. The module can in particular be configured as separable.

In accordance with a further embodiment, a track section installation module can be provided which removes at least one transport body having —preferably new—rails from the conveyor track and installs a track section with the inclusion of rails likewise conveyed in.

The track section installation module can have an apparatus for the detection, monitoring and optionally recording of installation parameters such as the tightening torque and the angle of rotation of the sleeper screws, an apparatus for the photographic documentation of the installed track section, an apparatus for grinding or milling off the mill scale of the rails, an apparatus for applying a profile to the rail heads by means of grinding or milling, an apparatus for connecting the rail pieces to be installed even before the installation by means of separation butt welding and/or an apparatus for measuring the zero voltage temperature.

Optionally, the track section installation module can have an apparatus which is configured to installed the rails with correct zero voltage. This can take place by initial heating, for instance by means of inductance or heat irradiation.

A track section installation module as described above is able to place the new track section down such that it comes to lie offset by a considerable amount with respect to the old previously removed track section. With conventional machines, at most a few decimeters offset can be achieved in this respect. In contrast, an offset of more than one meter can be achieved using a track section installation module as described above. This is effected mechanically by the steering function which is anyway required for working in curves. The measurement technique must, however, be configured for the large offset.

In accordance with a further embodiment, a ballast addition, tamping and dressing module is provided which tamps the laid track and optionally carries out a ballast addition. If required, a compacting of the ballast can be carried out at the shoulder in parallel with the tamping process.

The supply with ballast in this respect preferably takes place by the tipping out of the contents of at least one transport body delivered by the conveyor track. The apparatus for tipping out the ballast can optionally be designed separably from the tamping device. If the tamping module is used in a work configuration with a plurality of other modules, a fixed coupling is preferably provided such that the conveyor track between the two modules is not interrupted. If the tamping module is working on its own, the ballast supply module can be coupled such that the tamping module can move by some meters independently of the ballast supply module. If the tamping module is to be operated in a similar manner to a conventional tamping machine without ballast supply, the taking along of a ballast supply module can also be dispensed with.

If two or more tamping modules are used in a working configuration, they can be supplied with additional ballast from a ballast supply module.

The ballast addition, tamping and dressing module can have an apparatus for detecting and documenting the tamping parameters and/or the dressing parameters.

In another respect, the ballast addition, tamping and dressing module can be equipped with the same auxiliary and additional apparatus as were already described above.

In accordance with a further embodiment, a ground improvement module or rock excavation module is provided which is configured to apply building lime and/or cement to the contacting formation and to mill it into it. A rotary grinder provided for this purpose can also be used for cutting out rock.

The material to be introduced can advantageously be transported in by an especially adapted transport body. To further optimize the operation on the conveyor track, the transport body can be temporarily removed from the roller track if required.

In accordance with a further embodiment, an energy module is provided which supplies further modules of different types with energy, in particular with electrical energy.

In addition to a current generator by means of a diesel engine, a fuel cell or a gas turbine could also be provided for current supply. Optionally, the supply with electrical current can also take place via an existing overhead line.

The refilling of the fuel tank of the energy module can take place using a content of a transport body conveyed in on the conveyor track. If desired, the transport body can be removed from the conveyor track during the filling of the fuel. Optionally, the fuel tank of the energy module can thus be dispensed since the supply of the energy module can take place directly from the tank of a transport body.

Furthermore, a guide/control and documentation module can be provided in which all work parameters are centrally stored and all measured values are monitored and optionally documented. Optionally, this module can be equipped with devices for the analysis, preferably the chemical analysis, of material flows or liquid flows.

Inspection windows for observing the exchange of material on the conveyor track and/or for observing the long-welded rail transportation in a long-welded rail transportation apparatus can also be provided.

In accordance with a further embodiment, a bulk material unloading module is provided. If bulk materials such as removed ballast or removed formation material are to be supplied to a recycling process, the respective bulk material is first removed from the transport container. For this purpose, at least one transport body is temporarily removed from the conveyor track and its content is tipped out into a container within the module. In the following, the tipped out bulk material is transferred to a further module as a volume flow using a conveyor such as a belt conveyor.

A separation of the ballast from the adhering contaminant already takes place by means of an excavation chain during the excavation process. It is to be expected that this separation does not take place to the required degree on the excavation by means of the bucket. The ballast transfer module can therefore optionally be provided with an apparatus by means of which this separation process is effected. e.g. by the introduction of mechanical energy.

Optionally, the bulk material unloading module can be equipped with an apparatus for measuring the volume flow and/or the mass flow.

Optionally, a store can be provided for the bulk material to be tipped out. The movement of the transport bodies on the conveyor belt can thus be more easily optimized.

Furthermore, a bulk material process module can be provided in which a dry, partly wet, or wet ballast recycling process takes place.

Furthermore, a bulk material loading module can be provided which loads the respective bulk materials back into the transport body for transporting away after or during the processing as part of a recycling process. Such a bulk material loading module preferably loads a material flow, e.g. conveyed in by means of a conveyor belt, in at least one transport body removed from the conveyor track for this purpose.

Optionally, such a bulk material loading module can have an apparatus which guides through one material flow or a plurality of material flows and transfers it to a subsequent module.

All the above-described modules preferably work with a continuous material flow. However, a load-wise process may be better suited for the processing of small material amounts such as arise on a points renewal.

Individual ones of the above-described modules can also take over work for other modules. Individual modules can thus comprise an energy supply and thus supply other modules with energy. A drive device can also be provided only in one module or in some of the modules to move the railroad work vehicle. In accordance with a further embodiment of the invention, the railroad work vehicle can have a weight management to carry out a removal of the weight over some of the modules. This has the advantage that individual modules temporarily do not have to remove any weight. This is in particular advantageous at the start and at the end of the construction site as well as when passing over irregularities and for maintenance and repair purposes.

Finally, the transport bodies can also be weighed before and/or after the filling and/or after the emptying to determine, and optionally to document, what amount of which transport material was installed or removed at which site.

All the previously described variants and embodiments are essential to the invention both per se and in any desired combination and thus each form a subject matter of the invention.

An embodiment of the invention is represented in the drawing and will be described in the following. The only FIGURE shows FIG. 1 a side view of a railroad work vehicle in accordance with the invention.

The railroad work vehicle in accordance with the invention shown in FIG. 1 comprises a chassis 2 supported by a truck 1 and work devices 3, 4 supported by the chassis 2. An excavation device 3 and an installation device 4 are shown here by way of example.

A conveyor track 5 on which transport bodies 6 for goods can be moved along the work vehicle is provided above the work devices 3, 4. The conveyor track 5 is in this respect configured as a roller conveyor having rollers 7 on which the transport bodies configured as boxes can be moved. The rollers 7, or at least individual rollers 7, can be rotatably drivable for moving the transport bodies 6.

The transport bodies 6 can receive all types of goods, in particular work material such as ballast, sand, gravel, cement, sleepers, ironware, platelets, asphalt, materials for ground improvement, collision stub posts and signal foundations, but also supply materials such as fuel and water. They can serve both for the supply and for the disposal of the work devices 3, 4 of the work vehicle.

The transport bodies 6 can, for example, be loaded with excavation material of the excavation device 3 over a conveyor belt 8. The transport bodies 6 can be moved between a loading position 9 and the conveyor track 5 for this purpose.

To supply the installation device 4, a conveyor belt 10 can likewise be provided which can be filled with material from the transport bodies 6 via a filling device 11. For this purpose, a device not shown here can be provided at a filling position 12 for emptying the transport containers 6.

The work vehicle shown in FIG. 1 can represent a module of a railroad work vehicle. A plurality of such modules can be assembled in accordance with the invention. In this respect, each module can have different work devices; however, two or more modules which are the same can also be assembled. The conveyor tracks 5 of the modules are configured such that the conveyor tracks of a plurality of modules form a continuous conveyor track. The conveyor tracks 5 can also form a continuous conveyor track, for example with supply and/or disposal trains, with corresponding conveyor tracks of other track vehicles.

REFERENCE NUMERAL LIST

1 truck
2 chassis
3 excavation device
4 installation device
5 conveyor track
6 transport body
7 roller
8 conveyor belt
9 loading position
10 conveyor belt
11 filling device
12 unloading position
I direction of travel

The invention claimed is:

1. A railroad work vehicle having a chassis (2) supported by a truck (1) and having work devices (3, 4) for carrying out work at rail carriageways, the work devices (3, 4) supported by the chassis (2), further comprising at least one conveyor track (5) which is arranged beneath or above or next to the work devices (3, 4), with transport containers (6) for articles being able to be transported along the work vehicle on said conveyor track;

further comprising an apparatus configured to carry out at least one of the following functions selected from the group consisting of the removal temporarily or permanently of at least one transport container (6) from a conveyor track (5), and the changing of transport containers (6) between two conveyor tracks (5).

2. The railroad work vehicle in accordance with claim 1, wherein the transport containers (6) can be moved on the conveyor track (5) without additional loading means.

3. The railroad work vehicle in accordance with claim 1, wherein the transport containers (6) can be moved directly on the conveyor track (5).

4. The railroad work vehicle in accordance with claim 1, wherein the conveyor track (5) extends at least substantially horizontally.

5. The railroad work vehicle in accordance with claim 1, wherein the conveyor track (5) and the transport containers (6) are configured for the supply and/or removal of at least one member selected from the group comprising material for the work vehicle and material for work devices (3, 4) of the work vehicle; and/or wherein the conveyor track (5) is configured for the conveying of rails and/or of a track section.

6. The railroad work vehicle in accordance with claim 1, wherein the transport containers (6) can be moved individually in both directions on the conveyor track (5).

7. The railroad work vehicle in accordance with claim 6, wherein the work vehicle is configured such that the train traffic is at least possible on an adjacent track during use and such that the railroad loading gauge of a train traveling on a counter-track is not impinged on.

8. The railroad work vehicle in accordance with claim 1, further comprising at least two mutually parallel conveyor tracks (5), the transport containers (6) being moveable along the at least two mutually parallel conveyer tracks (5); wherein at least two conveyor tracks (5) extend next to one another or above one another on the railroad work vehicle.

9. The railroad work vehicle in accordance with claim 8, wherein the at least two mutually parallel conveyor tracks (5) are provided such that the transport containers (6) can be moved each in both directions or in opposite directions along the conveyor tracks (5).

10. The railroad work vehicle in accordance with claim 1, wherein the conveyor tracks (5) are formed by carriageways, roller conveyors, slideways, elevated tracks, suspended tracks, conveyor belts, or conveyor chain tracks.

11. The railroad work vehicle in accordance with claim 1, wherein the transport containers (6) can be coupled to one another mechanically.

12. The railroad work vehicle in accordance with claim 1, further configured to allow lateral loading and unloading of the transport containers (6).

13. The railroad work vehicle in accordance with claim 1, wherein the apparatus for the removal temporarily or permanently of at least one transport container (6) from a conveyor track (5) is provided for filling or emptying a transport container outside the conveyor track.

14. The railroad work vehicle in accordance with claim 1, wherein the transport containers (6) are configured as open or closed containers or as support boards.

15. The railroad work vehicle in accordance with claim 1, wherein the work vehicle has a rail-mounting and/or a traveling base.

16. The railroad work vehicle in accordance with claim 1, wherein the work vehicle is configured such that a train traffic is at least possible on an adjacent track during use.

17. The railroad work vehicle in accordance with claim 1, wherein the transport containers (6) can be moved individually and/or in groups and/or all together.

18. The railroad work vehicle in accordance with claim 1, wherein the transport containers (6) are provided with a machine-readable code.

19. The railroad work vehicle in accordance with claim 1, wherein the transport containers (6) can be latched in transport with respect to one of the conveyor tracks (5) and/or with respect to the railroad work vehicle.

20. The railroad work vehicle in accordance with claim 1, wherein the railroad work vehicle has an additional loading and/or conveying possibility for liquids or gases.

21. The railroad work vehicle in accordance with claim 1, further comprising an apparatus for the mechanical transfer of transport containers between the work vehicle and another work vehicle or a transport vehicle provided at at least one end of the work vehicle.

22. The railroad work vehicle in accordance with claim 1, wherein the railroad work vehicle comprises two or more modules, the modules comprising at least one member selected from the group of devices consisting of current supply devices, inverter devices, control devices, monitoring devices, documentation devices, and braking devices.

23. The railroad work vehicle in accordance with claim 22, wherein at least one module has a travel drive for moving on a track.

24. The railroad work vehicle in accordance with claim 22, wherein two or more modules can be rigidly coupled to one another.

25. The railroad work vehicle in accordance with claim 22, wherein the weight of one or more modules can be removed at least temporarily via one or more other modules.

26. The railroad work vehicle in accordance with claim 1, wherein the movement and/or the loading and/or unloading of the transport containers (6) can be remotely controlled.

27. The railroad work vehicle in accordance with claim 1, wherein the railroad work vehicle comprises two or more modules, wherein at least one module or a plurality of modules are provided with additional devices for a plurality of modules or for all modules.

28. A method of carrying out work at rail systems, using a railroad work vehicle having a chassis (2) supported by a truck (1), having work devices (3, 4) for carrying out work at rail carriageways, the work devices (3, 4) supported by the chassis (2), and having at least one conveyor track (5) which is arranged beneath or above or next to the work devices (3, 4), with transport containers (6) for articles being able to be transported along the work vehicle on said conveyor track;

wherein the transport containers (6) are weighed before and/or after the filling and/or after the emptying; and wherein it is determined and/or documented from this what amount of which transport material was removed or installed at which point.

29. The method in accordance with claim 28, wherein one or more modules of railroad work vehicles are assembled.

30. The method in accordance with claim 28, wherein individual modules are used temporarily; and/or wherein the order of the modules is changed during the carrying out of the work.

31. The method in accordance with claim 28, wherein one module or a plurality of modules from one end of the work vehicle is/are arranged temporarily at the other end or at another position within the work vehicle.

32. The method in accordance with claim 28, wherein the removal of the weight is controlled.

33. The method in accordance with claim 32, wherein the controlled removal of the weight only takes place via some of the modules.

34. A railroad work vehicle having a chassis (2) supported by a truck (1) and having work devices (3, 4) for carrying out work at rail carriageways, the work devices (3, 4) supported by the chassis (2), further comprising at least one conveyor track (5) which is arranged beneath or above or next to the work devices (3, 4), with transport containers (6) for articles being able to be transported along the work vehicle on said conveyor track, further comprising a drive for moving the transport containers (6) along the conveyor tracks (5) which drive is provided at the railroad work vehicle or wherein at least some of the transport containers (6) are provided with the drive, wherein the drive is configured for generating a cornering of the transport containers (6) in accordance with a track arc of the travel track and/or for moving the transport containers (6) at upward gradients, downward incline paths and cambers of a track.

35. The railroad work vehicle in accordance with claim 34, wherein the drive is provided in at least one conveyor track (5) and/or outside the conveyor track.

36. A railroad work vehicle having a chassis (2) supported by a truck (1) and having work devices (3, 4) for carrying out work at rail carriageways, the work devices (3, 4) supported by the chassis (2), further comprising at least one conveyor track (5) which is arranged beneath or above or next to the work devices (3, 4), with transport containers (6) for articles being able to be transported along the work vehicle on said conveyor track, wherein a control is provided by means of which the transport containers (6) can be sorted on the conveyor tracks (5).

37. A railroad work vehicle having a chassis (2) supported by a truck (1) and having work devices (3, 4) for carrying out work at rail carriageways, the work devices (3, 4) supported by the chassis (2), further comprising at least one conveyor track (5) which is arranged beneath or above or next to the work devices (3, 4), with transport containers (6) for articles being able to be transported along the work vehicle on said conveyor track, wherein a weighing device is provided for weighing the transport containers (6) before and/or after filling and/or after emptying the transport containers.

* * * * *